US005652967A

United States Patent [19]

Hsu

[11] Patent Number: 5,652,967

[45] Date of Patent: Aug. 5, 1997

[54] SPORT PROTECTOR

[76] Inventor: Kevin Hsu, P.O. Box 90, Tainan 704, Taiwan

[21] Appl. No.: 635,750

[22] Filed: Apr. 22, 1996

[51] Int. Cl.[6] ..... A41D 13/00

[52] U.S. Cl. ..... 2/463; 2/455; 2/462; 2/467; 2/465

[58] Field of Search ..... 2/455, 463, 459, 2/465, 461, 462, 467

[56] References Cited

U.S. PATENT DOCUMENTS

| | | | |
|---|---|---|---|
| 1,136,307 | 4/1915 | Bourdon | 2/461 |
| 4,272,847 | 6/1981 | Buhler | 2/461 |
| 4,516,273 | 5/1985 | Gregory et al. | 2/462 |
| 4,996,720 | 3/1991 | Fair | 2/462 |
| 5,024,993 | 6/1991 | Siemens | 2/465 |
| 5,187,812 | 2/1993 | Neuhalfen | 2/463 |
| 5,226,192 | 7/1993 | Jones et al. | 2/461 |
| 5,524,641 | 6/1996 | Battaglia | 2/463 |

*Primary Examiner*—Bibhu Mohanty

[57] ABSTRACT

A sport protector includes a chest-and-back protector, two shoulder guards and two arm guards. The chest-and-back protector and the arm guards have elastic paddings provided with air apertures and small air holes in walls of each air aperture for air to flow out so as to disperse shock in addition to absorb shock at the same time. Further, the air apertures are useful for heat produced by the body of a user to escape out, furnishing comfort to the user in wearing the protector. Besides, a reinforcing plate is respectively added on an outer side of the chest-and-back protector and the arm guards to increase endurable force against shock.

1 Claim, 5 Drawing Sheets

SPORT PROTECTOR

BACKGROUND OF THE INVENTION

This invention concerns a sport protector, particularly having elastic paddings additionally provided with air apertures and small air holes in walls defining each air aperture, thereby furnished with an excellent shock absorbing function and comfort for a user in wearing the protector.

Known conventional sport protectors are generally formed of protective paddings made of PU foam rubber, and the paddings have plural separated walls and shock absorbing blocks in an inner side. However, they have drawbacks as follows.

1. The paddings are closed, impossible to let heat produced by the body of a wearer to escape out so that the wearer is liable to perspire, feeling uncomfortable.

2. The separated walls are thin and of bad elasticity, and shock is only absorbed by the shock absorbing blocks, without air flowing function or much shock-absorbing effect.

SUMMARY OF THE INVENTION

The purpose of the invention is to offer a sport protector having an excellent shock absorbing function and good ventilation effect.

The main feature of the invention is a chest-and-back protector and two arm guards respectively having an integral elastic padding, which is provided with air apertures and small air holes in walls defining each air aperture. The chest-and-back protector has its front chest portion and its rear back portion provided with a reinforcing plate on an outer surface of an intermediate section. And the two arm guards also have a reinforcing plate on an outer surface, and each reinforcing plate also has air apertures corresponding to those in each elastic padding. Further, the chest-and-back protector, the two arm guards and two shoulder guards are all covered with a reinforcing net.

BRIEF DESCRIPTION OF DRAWINGS

This invention will be better understood by reference to the accompanying drawings, wherein.

DESCRIPTION OF THE PREFERRED EMBODIMENT

Figure 1:
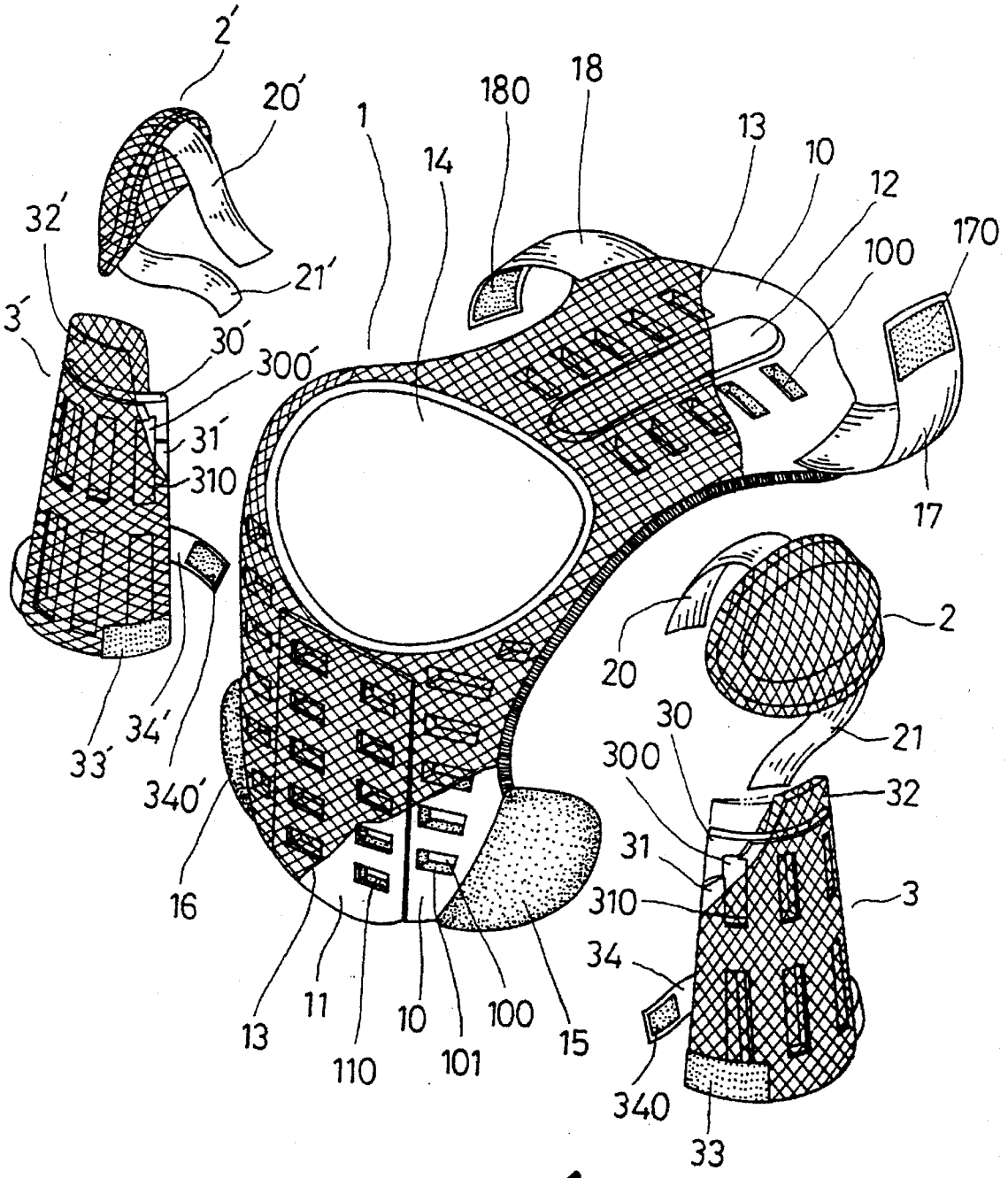
FIG. 1 is an exploded perspective view of a sport protector in the present invention.
Figure 2:
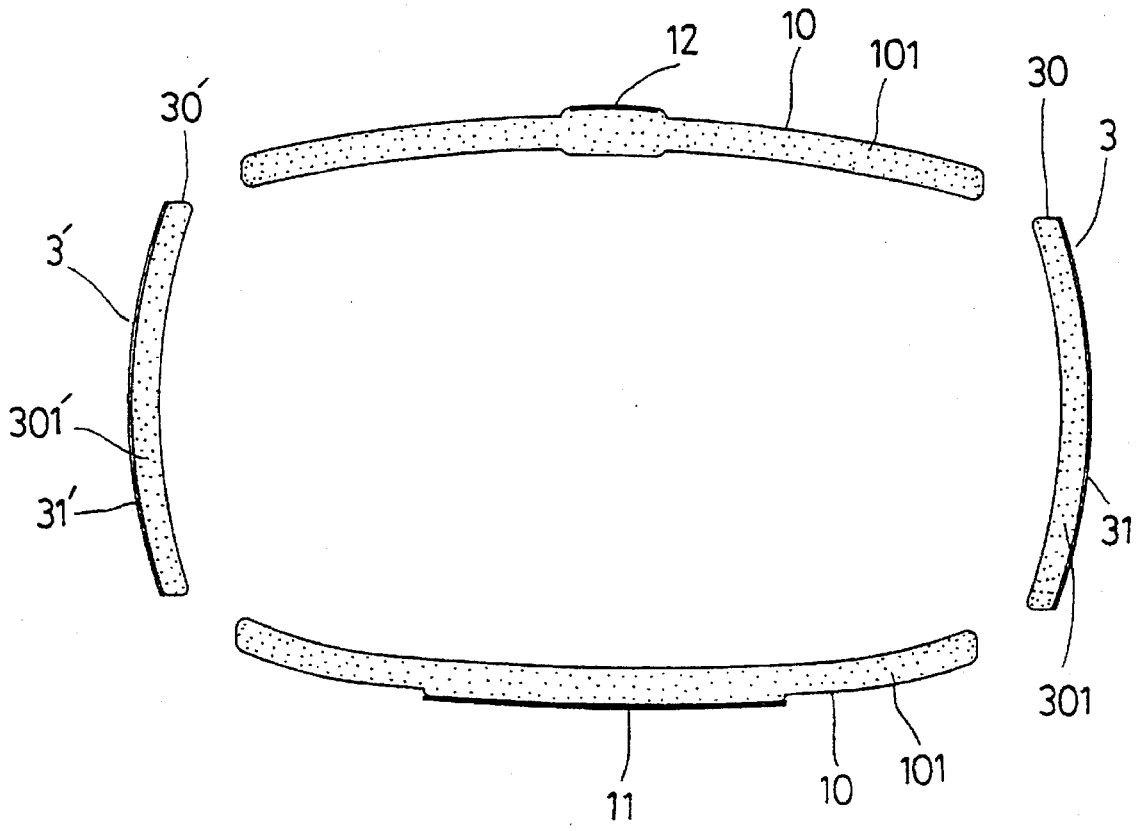
FIG. 2 is a cross-sectional view of a chest-and-back protector and two shoulder guards of the sport protector in the present invention.

A sport protector in the present invention, as shown in FIGS. 1 and 2, includes a chest-and-back protector 1, two shoulder guards 2, 2', and two arm guards 3, 3', combined together.

The chest-and-back protector 1 has an elastic padding 10 provided with a plurality of air apertures 100 arranged regularly in rows and lines, and small air holes 101 in walls defining each air aperture 100, an reinforcing plates 11 and 12 fixed on an intermediate section of a chest portion and of a back portion provided with air apertures 110 corresponding to the air apertures 100 of the elastic padding 10. A reinforcing net 13 is additionally covered on the reinforcing plates 11 and 12 fixed on the elastic padding 10. Further, the chest-and-back protector 1 has a center large opening 14 for the head of a user to pass through, two cotton patches 14, 15 respectively connected with lower corners of two opposite sides of the front chest portion, two straps 17, 18 respectively sewn with lower corners of two opposite sides of the rear back portion, having a VELCRO patch 170, 180 fixed on two ends.

The two shoulder guards 2, 2' are respectively sewn with two opposite sides of the center large opening 14, having two elastic bands 20, 21; 20', 21' and a reinforcing net 22; 22' covering on its outer surface.

The two arm guards 3, 3' are to cover two arms of a user, sewn with two opposite sides of the large opening 14, having elastic paddings 30, 30', and a plurality of air apertures 300, 300' arranged regularly in rows and lines, a plurality of small air holes 301, 301' in walls defining each air aperture 300, 300', reinforcing plates 31, 31' fixed on an outer surface of the elastic paddings 30, 30' and having air apertures 310, 310' just on related air apertures 300, 300' of the elastic paddings 30, 30', and reinforcing net 32, 32' fixed on the reinforcing plates 31, 31'. Further, the two arm guards 3, 3' respectively have two cotton patches 33, 33' and two straps 34, 34' sewn with lower corners of two opposite sides. The two straps 34, 34' have VELCRO patches 340, 340' on the outer ends.

Figure 3:
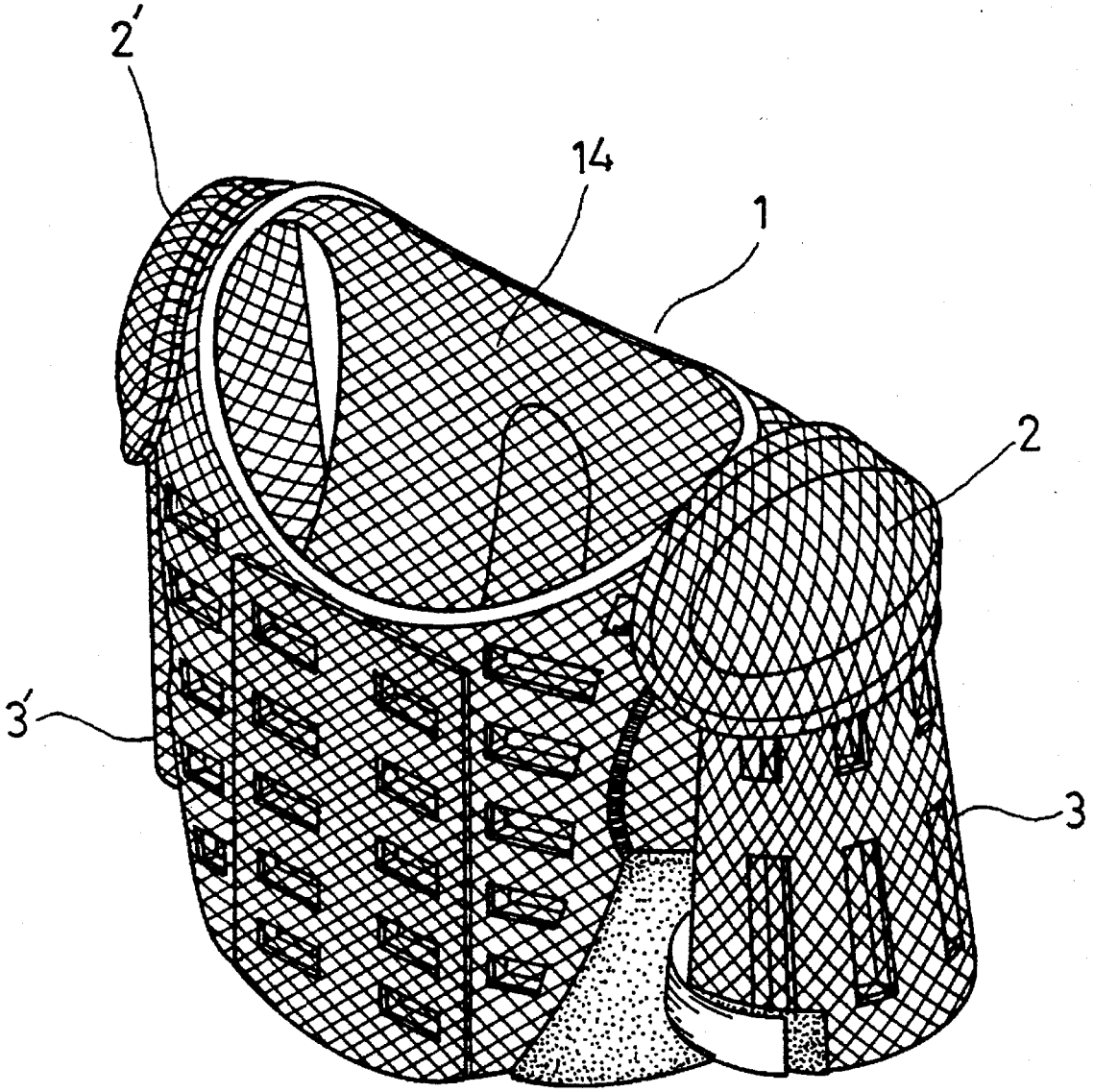
FIG. 3 is a perspective view of the sport protector in the present invention.

In assembling, referring to FIGS. 3, firstly, the two elastic bands 20, 20' of the two shoulder guards 2, 2' are sewn with two opposite inner sides of the large opening 14 of the chest-and-back protector 1, and then the two elastic bands 21, 21' are pulled down and sewn with two opposite outer side edges of the large opening 14. Then an upper end of each arm guard 3, 3' is bent and sewn with the outer opposite side edges of the large opening 14, finishing assemblage of this protector.

Figure 4:
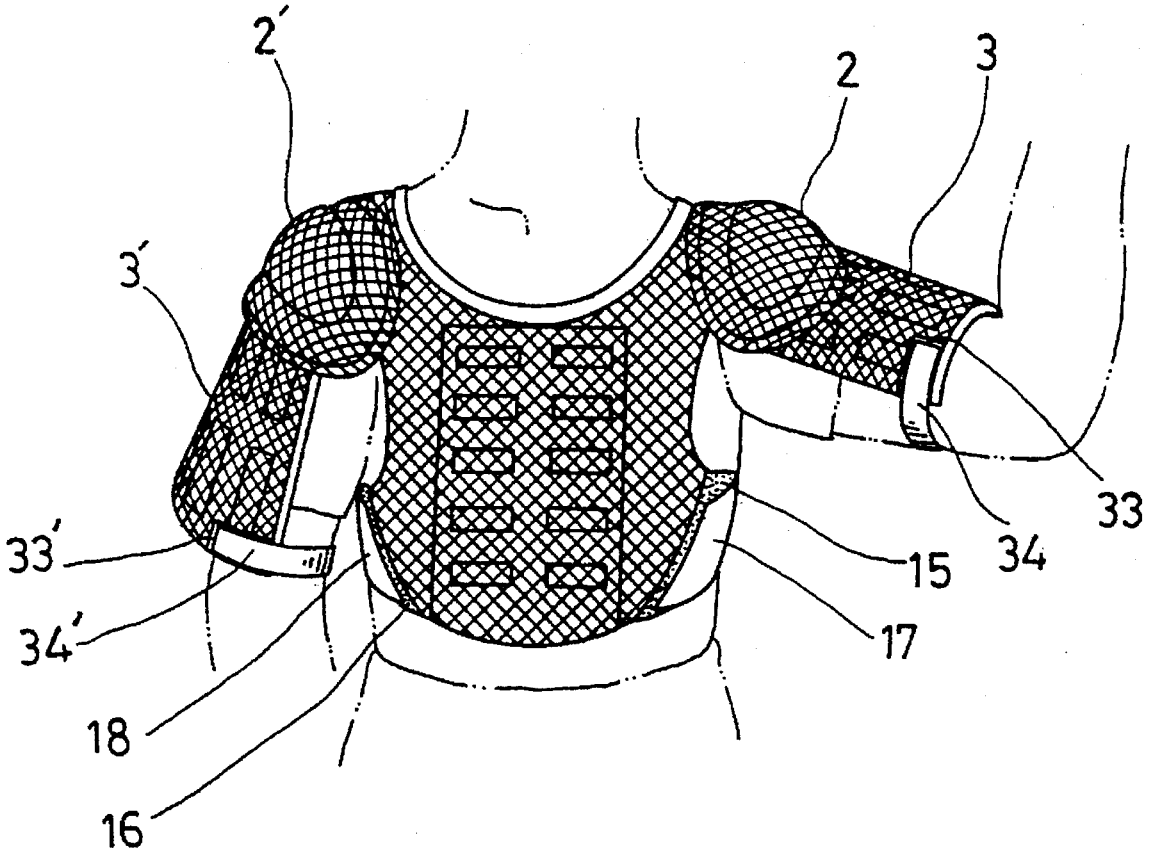
FIG. 4 is a perspective view of the sport protector worn on a person in the present invention.

In wearing this protector, referring to FIG. 4, the large opening 14 is put through down the head of a user, and the straps 17, 18 are pulled to the front side, with the Velcro patches 170, 180 respectively hooking tightly with the Cotton patches 15, 16 of the chest-and-back protector 1. Then the straps 34, 34' of the arm guards 3, 3' are pulled through the inner side of the arms to the other corners of the lower sides of the arm guards 3, 3', with the Velcro patches 340, 340' hooking tightly with the cotton patches 33, 33', finishing wearing this protector.

Figure 5:
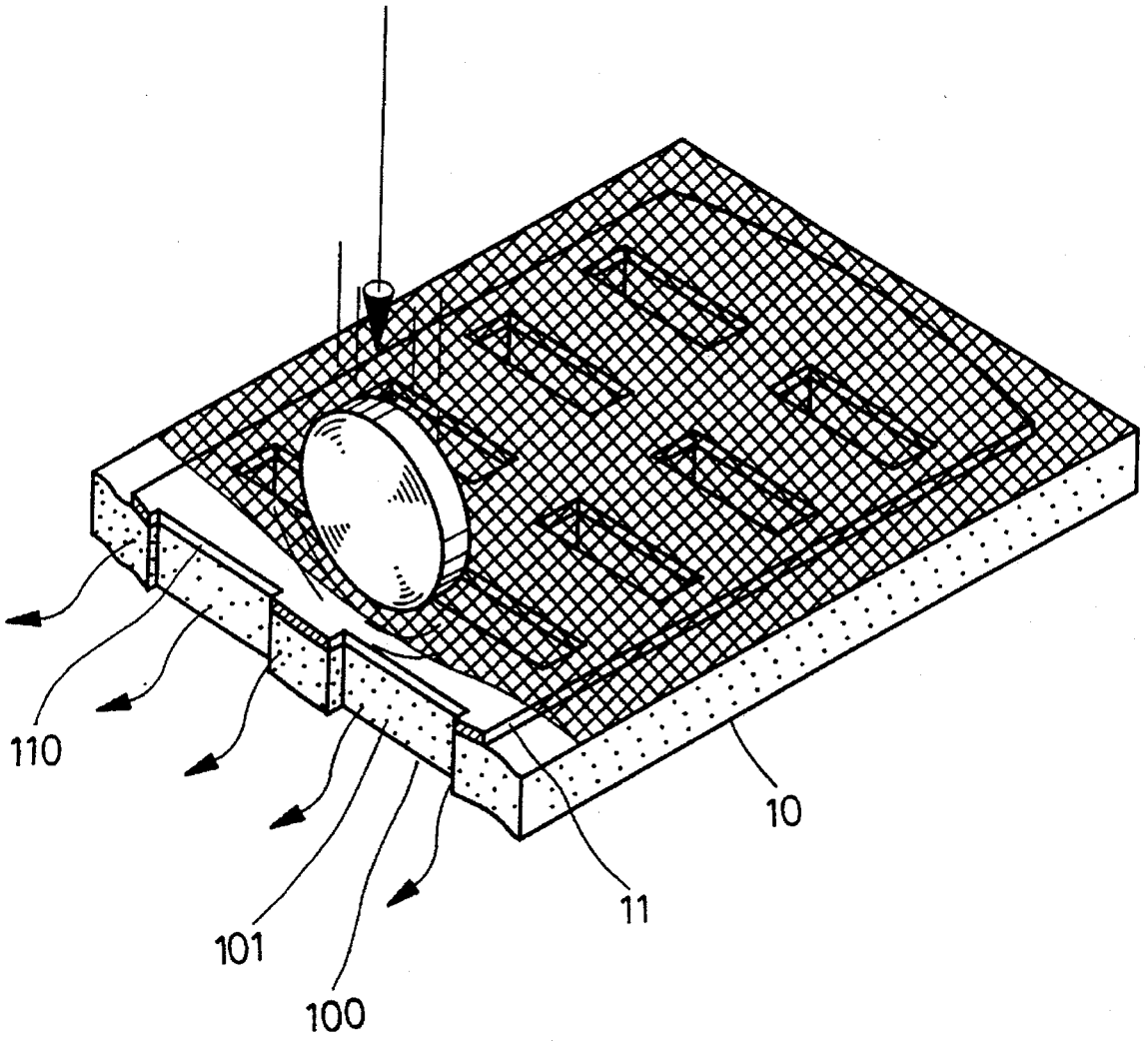
FIG. 5 is a perspective view of an elastic padding of the sport protector receiving a shock in the present invention.

In using, referring to FIG. 5, if a ball strikes on the chest-and-back protector 1, or the arm guards 3, 3', air current is formed in the air holes 101, 301, 301' of the elastic paddings 10, 30, 30' and flows out of them, effectively dispersing the striking force of the ball out of the air holes 101, 301, 301'. In addition, the elastic paddings 10, 30, 30' are respectively formed integral and have an even thickness, dispersing the striking force from the striking point to its surrounding areas with an excellent shock-absorbing effect. Further, the reinforcing plates 11, 12, 31, 31' cover the most vulnerable parts of a human body, increasing endurable force against shock to reduce sport harm and wound. Besides, the reinforcing nets 13, 32, 32' of the chest-and-back protector 1 and the two arm guards 3, 3' have a large effect against friction, able to reduce rotating force of a ball, and thus the striking shock of the ball may be lessened. Further, the air apertures 100, 300, 300' can permit heat produced by the body and arms of a user flow out of them in convection, resulting in comfort in wearing.

As can be understood from the above description, this protector has advantages as follows.

1. The elastic paddings are made integral so that they can be produced speedily to lower the cost in a great degree.

2. Provision of the air apertures enables the heat produced from the body escape out of them in convection, permitting wearing this protector comfortable.

3. When a ball strikes the elastic paddings, air flows out of the air holes, effectively dispersing the striking shock force and thus heightening shock absorbing effect greatly.

4. The reinforcing plates can increase shock endurable function, reducing harm and wound.

While the preferred embodiment has been described above, it will be recognized and understood that various modifications may be made therein and the appended claims are intended to cover all such modifications which may fall within the spirit and scope of the invention.

What is claimed is:

1. A sport protector comprising:

a chest-and-back protector having a large hole in an intermediate portion for a head of a user to pass through for wearing said sport protector, a cotton patch respectively sewn on lower ends of two opposite sides of a front chest portion, a strap respectively sewn on lower ends of two opposite sides of a rear back portion, and said strap having a hook and loop type fastener patch on an outer end;

two shoulder guards respectively sewn with two opposite sides of the said chest-and-back protector, having an elastic band respectively at two opposite sides and a reinforcing net covering on an outer surface;

two arm guards respectively sewn with an outer edge of two opposite sides of said chest-and-back protector, a cotton patch sewn on a corner of a lower end, a strap sewn on the other corner of said lower end, said strap having a hook and loop type fastener patch on an outer end;

and characterized by said chest-and-back protector having an integral elastic padding provided with a plurality of air apertures arranged regularly in rows and lines, each said air aperture having a plurality of small air holes in walls defining said air aperture, said chest-and-back protector further having a reinforcing plate on an intermediate vertical portion of both said front chest portion and said rear back portion, said arm guards respectively having an integral elastic padding provided with a plurality of air apertures arranged regularly in rows and ones, each said air apertures having a plurality of small air holes in walls defining each said air aperture, each said arm guard respectively having a reinforcing plate thereon, said chest-and-back protector, each said arm guard and each said shoulder guard respectively having an outer reinforcing net, said air holes in said elastic paddings permitting air to flow out of said sport protector and a striking force of a ball disperse out of said air holes and thus performing effective action of absorbing shock so as to prevent or reduce bodily harm and wound to the least, said reinforcing plates serving to increase endurable force against shock, said air apertures furnishing excellent ventilation to give comfort to the user wearing said sport protector.

* * * * *